United States Patent [19]

Kusakabe et al.

[11] 4,047,987

[45] Sept. 13, 1977

[54] UNDERWATER BLASTING EXPLOSIVES

[75] Inventors: Masao Kusakabe; Shuzo Fuziwara, both of Hiratsuka; Kazuo Shiino, Odawara, all of Japan

[73] Assignee: Director-General of the Agency of Industrial Science and Technology, Tokyo, Japan

[21] Appl. No.: 639,962

[22] Filed: Dec. 11, 1975

Related U.S. Application Data

[62] Division of Ser. No. 445,911, Feb. 26, 1974, Pat. No. 3,952,655.

[30] Foreign Application Priority Data

| | | |
|---|---|---|
| Feb. 27, 1973 | Japan | 48-22628 |
| May 9, 1973 | Japan | 48-51345 |
| May 10, 1973 | Japan | 48-51937 |

[51] Int. Cl.[2] ..... C06B 33/00; C06B 33/10; C06B 29/00; C07B 21/00

[52] U.S. Cl. ..... 149/37; 149/39; 149/75; 149/105; 260/96.5 C

[58] Field of Search ..... 149/75, 88, 89, 105, 149/37, 39; 260/96.5 R, 96.5 C, 553 CD, 553 R, 555 R

[56] References Cited

U.S. PATENT DOCUMENTS

| | | | |
|---|---|---|---|
| 2,155,717 | 4/1939 | Künnle | 260/555 R |
| 2,279,765 | 4/1942 | Spaeth | 260/553 |
| 2,929,699 | 3/1960 | Audrieth | 149/16 |
| 2,980,505 | 4/1961 | Haas | 260/555 R |
| 3,141,039 | 7/1964 | Weichman | 260/553 |
| 3,265,730 | 8/1966 | Heubusch | 260/555 R |
| 3,411,962 | 11/1968 | Chaille | 149/75 |
| 3,457,127 | 7/1969 | Cook | 149/75 |
| 3,660,455 | 5/1972 | Hoffman | 149/75 |
| 3,695,947 | 10/1972 | Edwards | 149/75 |
| 3,904,602 | 9/1975 | Somlo | 260/553 R |

*Primary Examiner*—Samuel W. Engle
*Assistant Examiner*—Donald P. Walsh
*Attorney, Agent, or Firm*—William J. Daniel

[57] ABSTRACT

This invention relates to a method of removing underwater obstacles by blasting with a fluid explosure, a device for monitoring the execution of the method from a remote place, a fluid explosive composition especially suitable for the practice of the method, and a detonating device which is very suitable for detonating the fluid explosive. This underwater blasting method comprises the steps of injecting into a blasting hole drilled on an underwater obstacle an inert fluid which is immiscible with water and has a specific gravity greater than water, then injecting a fluid explosive having a specific gravity greater than the inert fluid to replace therewith a part of the inert fluid and thereafter detonating the injected explosive.

The monitoring device is provided with a means for electrically detecting the level of the fluid explosive injected into the blasting hole. The fluid explosive composition contains as the explosive ingredient urea perchlorate. The detonating device is a float provided with a detonator which can act upon the fluid explosive from a remote place.

11 Claims, 11 Drawing Figures

UNDERWATER BLASTING EXPLOSIVES

This is a division, of Ser. No. 445,911, filed Feb. 26, 1974, now U.S. Pat. No. 3,952,655 issued Apr. 27, 1976.

BACKGROUND OF THE INVENTION

This invention relates to a novel underwater blasting method for removing safely and economically underwater obstacles on the beds of lakes and seas by blasting with a fluid explosive, an apparatus for remotely monitoring the loading of the explosive in the underwater location where blasting is desired, a fluid explosive composition which is very suitable for such underwater blasting, and a detonating device which is very suitable for detonating the fluid explosive.

In recent years, sea development and bridge construction have greatly increased. These projects necessitate effective removal by blasting of obstacles lying on the bottom of the sea or lake. In the past, use has been made of the so-called "boring and blasting method" wherein blasting holes are drilled in the obstacle to be removed and a plastic or solid explosive loaded in the holes for blasting away the obstacle. However, this method has not been satisfactory from the standpoint of safety and economy.

For example, in the underwater blasting method generally followed in the prior art, a solid or plastic explosive such as dynamite or the like has ordinarily been employed. Because these explosives are difficult to load tightly into blasting holes, it is necessary to drill many blasting holes in those underwater blasting operations where a large amount of an explosive is required. Consequently, many days and considerable expense were required for the hole drilling.

The operations involved in loading a solid or plastic explosive charge in blasting holes and then detonating the charge can be done comparatively safely on dry land by loading the bulk of the explosive charge in each hole, then loading the so-called "parent explosive cartridge" having at one terminal end a detonator, and finally firing the detonator. In contrast, such work is difficult to perform underwater and a very dangerous method has been adopted wherein the entire explosive charge including the detonating device is then loaded into blasting holes by lowering it down through the water.

Furthermore, in previous underwater blasting methods employing a solid or plastic explosive, there was a very dangerous and difficult problem on disposing of residual explosive after a misfire.

In practicing underwater blasting, the use of a fluid explosive is considered more advantageous than a solid or plastic explosive in respect to loading the explosive in blasting holes and in the disposition of any misfired residual explosive. However, an underwater blasting method using a fluid explosive has not yet been developed. In addition, only an extremely small number of fluid explosives proposed hitherto are practically applicable. As seen in the case of nitroglycerin, some fluid explosives are chemically unstable and tend to be too sensitive to shocks and friction. Thus, many of the liquid explosives are dangerous to manufacture and handle.

One highly practical known slurry explosive is a super-saturated aqueous solution of ammonium nitrate incorporated with trinitrotoluene or powdery aluminum. However, this slurry explosive has the drawbacks that the solubility of ammonium nitrate in water is not high and its solubility is greatly affected by the temperature so that the ammonium nitrate can crystallize out and greatly change the explosive properties when the temperature falls during storage.

BRIEF SUMMARY OF THE INVENTION

Accordingly, it is a prime object of this invention to provide an underwater blasting method which can be carried out safely and economically free of the foregoing drawbacks in the prior art underwater blasting methods using a solid or plastic explosive.

It is another object of this invention to provide an underwater blasting method wherein a fluid explosive is used.

It is still another object of this invention to provide a safe and easy method of loading a fluid explosive in blasting holes on the bodies to be removed by blasting, such as underwater obstacles lying on the beds of seas or lakes, without permitting dispersion of the fluid explosive into water.

It is a further object of this invention to provide an apparatus for monitoring from a remote location the loaded condition of a fluid explosive in an underwater blasting operation.

It is still a further object of this invention to provide fluid explosive which is safe and easy to produce and handle which is suitable for underwater blasting.

It is still another object of this invention to provide a detonating device suitable for use in underwater blasting operations.

These and other objects, features and advantages of the present invention will become much more clear when the following detailed explanations and accompanying drawings are read.

In accordance with this invention, there is provided an underwater blasting method which comprises blasting underwater objects such as submarine obstacles to be removed by the use of a fluid explosive, characterized by the steps of injecting an inert fluid immiscible with both the fluid explosive and water and having an intermediate specific gravity between the two into a blasting hole or holes previously drilled in an object to be blasted, then injecting a fluid explosive having a specific gravity greater than water so that a layer of the inert fluid can be formed on the fluid explosive, thereby enabling the fluid explosive to be loaded in the blasting hole or holes in such manner that the fluid explosive is isolated from water, and thereafter detonating the fluid explosive thus loaded.

In contrast to the conventional underwater blasting methods, this method uses a fluid explosive. Various technical advantages can be obtained by using such fluid explosive: when a fluid explosive is used, (a) larger amounts of explosive can be loaded in in a blasting hole of a given capacity than in the case of a solid or plastic explosive so that the blasting effect can be maximized, the required number of blasting holes can be smaller and the length and the cost required for the work can be reduced greatly; (b) the loading of the explosive into blasting holes can be effected safely and easily by the use of a pipeline; and (c) in the case of failure in detonation after loading of the explosive, any misfired residual explosive can be safely and easily disposed of by dissolving or dispersing it in water.

DETAILED DESCRIPTION OF THE INVENTION

Figure 1A:
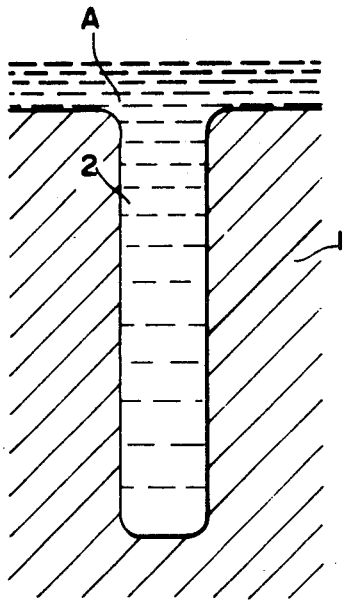
FIGS. 1A–1C are schematic views explaining the principle of loading a fluid explosive into a blasting hole according to the present invention.

The underwater blasting method of this invention will now be described below in detail with reference to the drawings. Referring to FIG. 1A, a blasting hole 2 is bored to a required depth by means of a drilling machine in an object 1 to be blasted, such as an underwater obstacle to be removed. Obviously, naturally existing holes may be used as the blasting holes. The drilling operation is the most expensive phase of any underwater blasting process. According to the present invention, however, each hole can be completely filled with fluid explosive so that the space between blasting holes can be increased, thereby reducing the number of blasting holes needed to be bored or drilled and achieving a remarkable saving in drilling costs. The depth and diameter of blasting holes and the clearance between the holes can properly be determined depending on the dimension or size of the object to be blasted and the performance and quality of the explosive used.

Figure 1B:
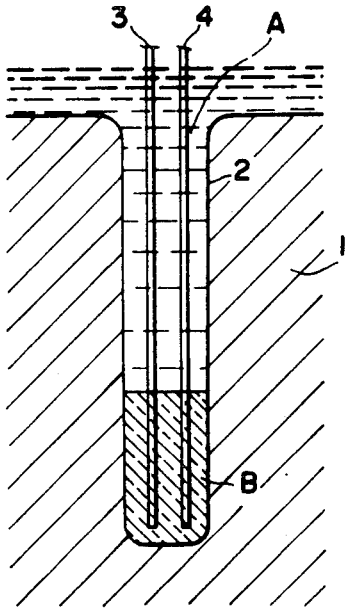
Figure 1C:
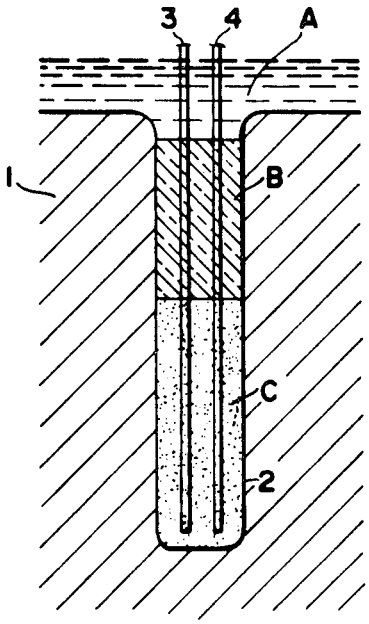

As shown in FIG. 1B, two flexible telescopical pipes 3 and 4 are inserted into the blasting hole 2 filled with water A, and then an inert fluid B is injected into the hole under pressure through the pipe 3 by means of a pump to replace at least a part of the water in the hole. Utilizable for the fluid B in this case is an inert fluid which is not miscible with either water or the fluid explosive used, usually having solubility of 0.1 g/100g or less, and has an intermediate specific gravity between the two, i.e., a specific gravity greater than that of water and smaller than that of the fluid explosive. Thus, when fed into the hole, the fluid B having a specific gravity greater than that of water will replace by itself the water in the hole and stay on the bottom of the hole as shown in FIG. 1B. The part of the water thus replaced flows out from the top of the hole. It is preferable to use as the fluid B a fluid having a high viscosity, usually a viscosity of 10–30 c.p. in order that the fluid does not flow out by movement of a stream of water near the opening. Such fluid B can be selected depending on the kind of the fluid explosive used. Since the fluid explosive usually has a specific gravity greater than 1.3, a fluid having a specific gravity of 1–1.3, such as a mixture of silicon oil and carbon tetrachloride having a specific gravity of 1.1–1.3, is used as the fluid B. After a predetermined amount of fluid B is injected into the blasting hole 2, a fluid explosive C is fed through another pipe 4 under pressure into the fluid B as shown in FIG. 1C. Since the fluid explosive C is not miscible with the fluid B and has a specific gravity greater than that of the fluid B, the explosive displaces the fluid B from the lower part of the blasting hole 2 whereby the fluid B is gradually forced to move upwardly by the amount equivalent to that of the fluid explosive C to a position as shown in FIG. 1C. If the fluid explosive C is fed under pressure, its amount is adjusted in such manner that an appropriate amount of a layer of the inert fluid B remains on a layer of the fluid explosive C in the blasting hole. The formation of the layer of a proper amount of the fluid B on the layer of the fluid explosive C enables the fluid explosive to be isolated from the water in the vicinity of the blasting hole and prevents the explosive from mixing with water or washing away. The preferable height of the layer of the fluid B remaining above the layer of the fluid explosive C varies according to the bore diameter ($\phi$) of the blasting hole and the viscosity of the fluid B. If the condition of $h/\phi > 2$ is satisfied in the case of using an inert fluid having a viscosity of about 25 c.p., it will be possible to avoid mixing of the fluid explosive C with water flowing around the blasting hole for 1 month or more, even though the water current around the blasting hole has a flow rate of about 5 meters per second.

By injecting in turn the inert fluid B and the fluid explosive C under pressure into the blasting hole as mentioned above, the fluid explosive can be loaded into the blasting hole 2 in such manner that the explosive has a layer of the inert fluid formed and held above the explosive to isolate it from the water.

The operation itself for injecting the fluid B and the fluid explosive C under pressure into blasting holes can be safely carried out on shore or on board a ship or boat. One length of pipe can be used in place of the two pipes 3 and 4.

In practicing this invention, a solid or plastic explosive can advantageously be used in combination with the fluid explosive. More specifically, a proper amount of a solid or plastic explosives is first loaded into the blasting hole and then a fluid explosive is loaded therein as mentioned above. In this case, the fluid explosive flows into the interstices of gaps between the solid or plastic explosive and the inner wall of the hole and the solid or plastic explosive, thus eliminating the disadvantage of the solid or plastic explosive in respect of difficulty in dense loading. In addition, conjoint use of a fluid explosive with a solid or plastic explosive assures propagation of detonation of individual solid or plastic explosives present in the fluid explosive by functioning as a propagation medium without any special precautions.

Figure 2:
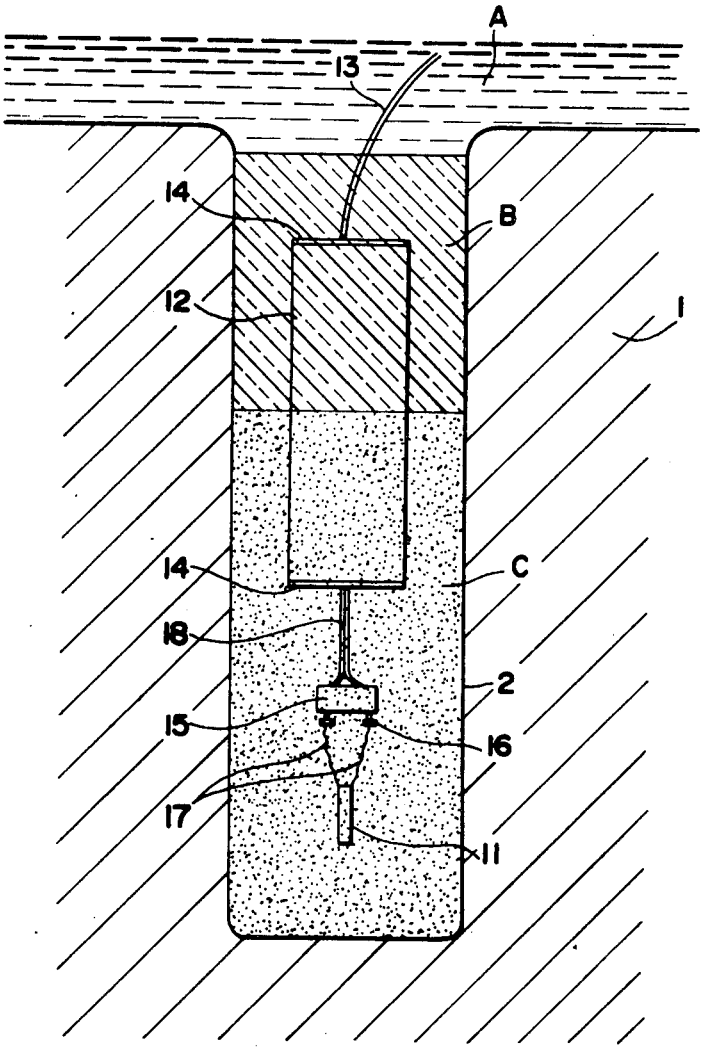
FIG. 2 is a diagrammatic cross-sectional view explaining the principle of the detonating device used for detonating the fluid explosive loaded in a blasting hole.

The explosive or mixture of explosives thus loaded can be detonated by means of an appropriate detonating device such as a percussion cap. However, according to the present invention, it is more advantageous to use a buoyant detonating device. FIG. 2 shows one embodiment of such a detonating device. This device comprises a detonator 11 and a float member 12 attached thereto, the detonator having a firing cable 13 connected thereto for remote actuation to detonate the explosive.

The float member 12 consists of a cylindrical container made of a suitable material such as brass and is adapted to provide the detonator 11 with adequate buoyancy to float or hold it stably in the fluid explosive. The float member is formed by a tubular member cut to a proper length and having lid members 14 mounted on its both terminal ends. The float member 12 can be formed in any shape and size adapted to be inserted into the blasting hole 2, but one in a cylindrical shape is usually employed. A cord 13, i.e., firing cable, is secured in a water-tight manner to the float member 12 through the upper lid member 14. The cord 18 extending from the lower lid 14 carries a pendant terminal block 15 being suspended therefrom. The terminal block 15 has a proper weight located therein so that its specific gravity becomes greater than that of the fluid explosive thereby enabling it to be suspended in a stable condition in the explosive. Terminals 16 of the terminal block 15 are connected with lead wires 17 of the detonator 11. Any kind of detonator adapted to be actuated electrically can be used as the detonator 11. Usually, however, an electrically actuated detonator is used for this purpose. The detonator 11 may be provided with a booster, if necessary.

Desirably, a proper weight is located inside the cylindrical body of the float member 12 so as to power its center of gravity thereby enabling it to be suspended in a stable condition.

The present detonating device is preferably designed so that the float member 12 can float in the neighborhood of the boundary between the layer of explosive C and the layer of fluid B inside the blasting hole 2 and can stably hold the detonator 11 in the explosive C.

Where the sectional area of the cylindrical float member 12 is represented by S $cm^2$, its height by $h$ cm, the density of the fluid B by $d_1$ $g/cm^3$, the density of the explosive C by $d_2$ $g/cm^3$ and the weight of the entire system of the device by M g by neglecting the bouyancy due to the detonator 11, and, when the condition of $Shd_2 > M > Shd_1$ is satisfied, the detonating device can float in a stable condition astride the boundary between the fluid b and the explosive C, with the detonator 11 being held at its lowermost position. The detonating device so arranged can be remotely actuated by sending thereto an electric current through firing cable 12 connected to the upper end of the float member 12.

Various modifications or changes can be made in the detonating device of this invention. For example, an electric wave signal or supersonic wave signal can be used to initiate the detonator instead of an electric current through the firing cable 13.

Where it is desired to actuate the detonator by an electric wave signal or a supersonic signal, a set of the necessary parts including a receiver, an amplifier, a switch device operable by an amplified signal and a dry battery for ignition, all properly connected to one another, are located inside the float member 12, and a receiving antenna is desirably arranged so as to be extended more than 30 cm outside the blasting hole. With such a detonating device, the detonator 11 can be initiated by transmitting an electric wave firing signal from a separately installed transmitter, receiving the signal by means of the antenna and actuating the switch device to supply the electric energy from the dry battery to the detonator itself.

In the blasting method according to this invention which allows the use of a fluid explosive and the injection of the explosive into a blasting hole from a remote supply source through an inert fluid by the aid of any desired fluid transporting means such as a pipe, there is no such difficulty and risk in practical operation as encountered in prior art methods. The insertion of the detonating device into the explosive can easily and safely be effected merely by inserting the device in the blasting hole after the explosive has been loaded.

Any fluid explosive which has a specific gravity greater than water, preferably 1.3 or more, and which can be transported through a pipe may be used in this invention. From the viewpoint of safe handling and easy disposition of misfired explosive, however, it is preferable to use a water-soluble explosive which hardly tends to cause a low velocity detonation.

According to this invention, there is provided an oxidizing agent/fuel base fluid explosive composition containing urea perchlorate as an oxidizing agent to meet the above-mentioned purpose.

This urea perchlorate can be prepared in the form of a highly concentrated solution by cooling a highly concentrated aqueous solution of perchloric acid and dissolving an appropriate amount of urea in the cooled solution. By concentrating and cooling the resulting solution, urea perchlorate can be obtained as crystals. The reaction is shown by the following equation:

$$HClO_4 + CO(NH_2)_2 \xrightarrow[H_2O]{} CO(NH_2)_2 \cdot HClO_4$$

As this process used perchloric acid itself as the starting material, it is costly and relatively disadvantageous for commercially operable process. According to the present invention, however, it has now been found that urea perchlorate can also be prepared in a high yield through another route, i.e., by reacting in an aqueous medium an ammonium or an alkali metal salt of perchloric acid (for example, sodium or potassium salt) with urea in the presence of a strong acid. This reaction is shown by the following equation:

$$MClO_4 + CO(NH_2)_2 + HX \xrightarrow[H_2O]{} CO(NH_2)_2 \cdot HClO_4 + MX$$

wherein M stands for an alkali metal or ammonium radical and X for an acid residue of a strong acid.

In this case, hydrochloric acid, sulphuric acid or nitric acid is suitably used as the strong acid. For preparing a highly concentrated aqueous solution, it is effective to blow gaseous hydrogen chloride into the reaction system. Although a chloride, sulfate or nitrate of an alkali metal or ammonium is produced as a by-produce of this reaction, such salt can be separated easily from the urea perchlorate by taking advantage of their difference in solubility in water, the solubility of urea perchlorate in water being extremely high while that of the by-product salt is relatively low.

Urea perchlorate thus obtained has a melting point of about 82° C and a solubility of 100 g of water at 20° C as high as 950° g. Furthermore, this compound has as one outstanding characteristic good solubility in various organic polar solvents, such as nitro compounds, alcohols, esters, ketones and amides.

This urea perchlorate is very stable and is not sensitive to shock, i.e., in drop hammer tests, its firing ratio was zero upon dropping 5 kg of a weight from a height of 60 cm.

A preferred example of fluid explosive used in this invention is a composition containing urea perchlocrate and a combustable polar liquid as its principal ingredients. The polar liquid used in this case is preferably one which is combustible and has a heat of molecular formation that is either negative or possibly small and which can scarcely dissolve urea perchlorate. Illustrative of such polar liquids are liquid nitro compounds, such as nitromethane nitroethane, nitropropane, nitrobenzene, and mononitrotoluene; liquid nitriles, such as acetonitrile and acrylonitrile; liquid esters, such as ethyl acetate and ethyl benzoate; liquid ketones, such as acetone, methyl ethyl ketone and acetophenone; and liquid amides, such as formamide, dimethylformamide, and dimethylsulfoxide.

This explosive composition is prepared by dissolving an appropriate amount, preferably at least 60% by weight of the total ingredients, of urea perchlorate in one or more of the above-mentioned combustible polar liquids. In this case, it is possible to add a small amount of water or a monohydric or polyhydric alcohol, such as methanol, ethylene glycol or glycerol to the polar liquids. These additives serve to increase the solubility of urea perchlorate in the polar liquids.

Another preferred example of fluid explosive is a liquid or slurry explosive which is prepared by adding a solid combustible agent to an aqueous solution of urea perchlorate. In this case, it is advantageous to use the aqueous solution of urea perchlorate as high in the concentration as possible. In general, however, a concentration of at least 50% is sufficient enough for this purpose. A part of the water which is a solvent in this solution can be substituted by a polar solvent which is miscible with water, for example, a monohydric or polyhydric alcohol, such as propanol, ethylene glycol, or glycerin; a ketone, such as acetone or methyl ethyl ketone; or an aldehyde, such as acetoaldehyde.

Utilizable as the combustible agent to be mixed with the solvent are combustible solid substances which are either soluble or insoluble in water. Examples of the combustible agents include inorganic combustible agents, such as powdered carbon and sulphur; organic combustible agents, such as urea and its derivatives, saccharides, such as cane sugar and lactose; organic nitro compounds, such as dinitrobenzene, dinitrotoluene, trinitrotoluene, dinitronaphthalene, picric acid and tetryl; and metallic combustible agents, such as aluminum and ferrosilicon powders. These substances are used advantageously in the form of powder. The type and quantity of these combustible agents are determined according to the purpose of the explosive.

The composition of the slurry explosive can be modified in various ways. For instance, the urea perchlorate used as oxidizing agent in the composition of this invention can be used in the form of a mixture with such water-soluble oxidizing agents as, for example, ammonium nitrate, sodium nitrate, sodium perchlorate, calcium perchlorate, potassium perchlorate and ammonium perchlorate. In this case, it is desirable that these oxidizing agents be used in a concentration which permits no precipitation of any crystals when the composition is cooled at about 0° C. It is possible to dissolve as a sensitizer a small amount of such combustible liquid substances as an aliphatic amine, acetonitrile, nitrobenzene, and aniline in an aqueous solution of urea perchlorate.

Some specific examples of fluid explosives containing urea perchlorate used in the present invention include the following, all density values being at 20° C:

Nitromethane/urea perchlorate (mixing ratio by weight — 80:20; density — 1.24), Nitromethane/urea perchlorate (30:70; density — 1.46), Nitromethane/urea perchlorate/water (20:78:2; density — 1.51), Nitrobenzene/urea perchlorate/water (10:88:2; density — 1.44), acetonitrile/urea perchlorate (10:90; density — 1.38), ethyl acetate/urea perchlorate (10:90; density — 1.39), acetophenone/water/methyl alcohol/urea perchlorate (8:2:3:87; density — 1.41), dimethylformamide/urea perchlorate (10:90; density — 1.40), urea perchlorate/-water/potassium perchlorate powder/ferrosilicon (42.5:7.5:20:30; density — 1.71), urea perchlorate/-water/urea nitrate/dinitrotoluene (59.5:10.5:15:15; density — 1.45), urea perchlorate/tetryl/ water (76:10:14; density — 1.6), urea perchlorate/picric acid/water (76:10:14; density — 1.6), and urea perchlorate/water-/aluminum/urea(69.75:11.25:15:10; density — 1.44).

Some specific examples of fluid explosives containing no urea perchlorate include:

Explosive mixtures containing hydrazine nitrate as the oxidizing agent, for example, hydrazine nitrate/-monoethanolamine/water (80:15:4; density — 1.42); hydrazine nitrate/ethylenediamine/water (80:16:4; density — 1.41); hydrazine nitrate/monomethylamine/hydroxyethyl hydrazine/water (75:6:4:15; density — 1.40); and aqueous explosive mixtures containing hydrazine perchlorate as the oxidizing agent, for example, hydrazine perchlorate/hydrazine/water (67.7:10.4:21.9; density — 1.45), hydrazine perchlorate/hydrazine/monoethanol amine/water (60.2:9.3:10.0:20.5; density — 1.38), and hydrazine perchlorate/sodium nitrate/hydrazine/-water (52.3:10.0:8.1: 29.6; density — 1.40).

Besides these, there can be mentioned such mixtures as ammonium nitrate/hexogen/water/viscosity raising agent (50:35:14:1; density — 1.4); and nitric acid/mixed fuel oil (density — 1.4/1.5).

Figure 3:
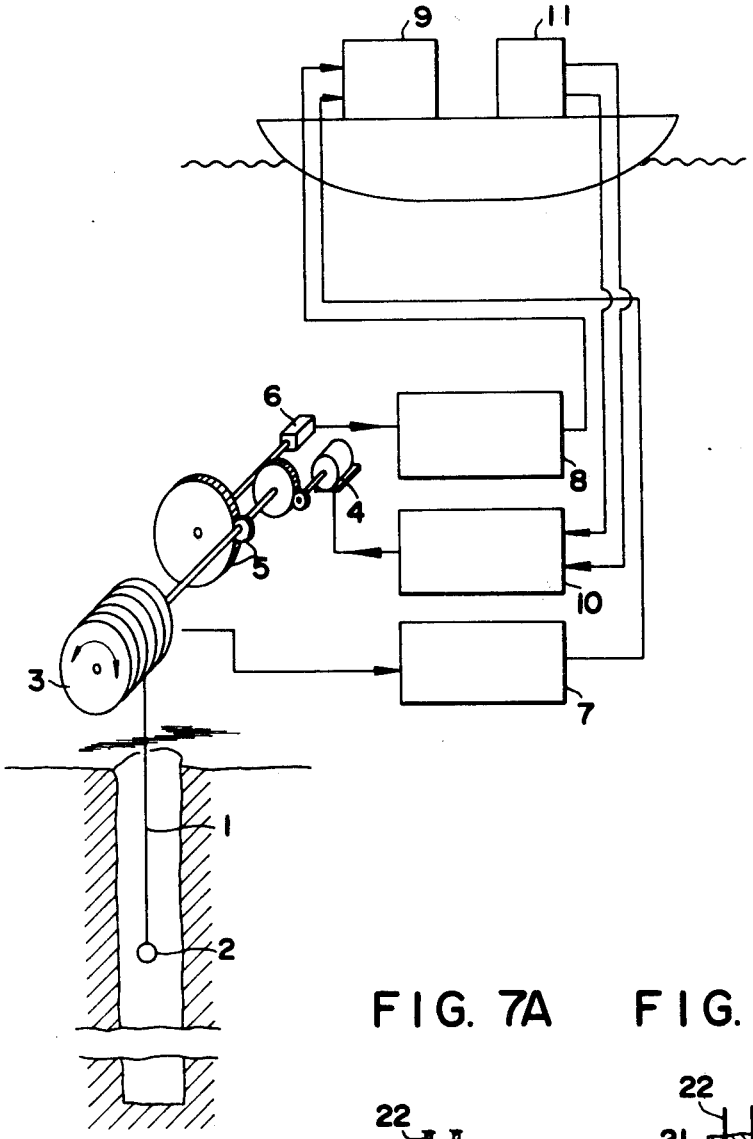
FIG. 3 is a schematic composite view showing the device for remotely monitoring the condition of the fluid explosive loaded into a blasting hole.
Figure 4:
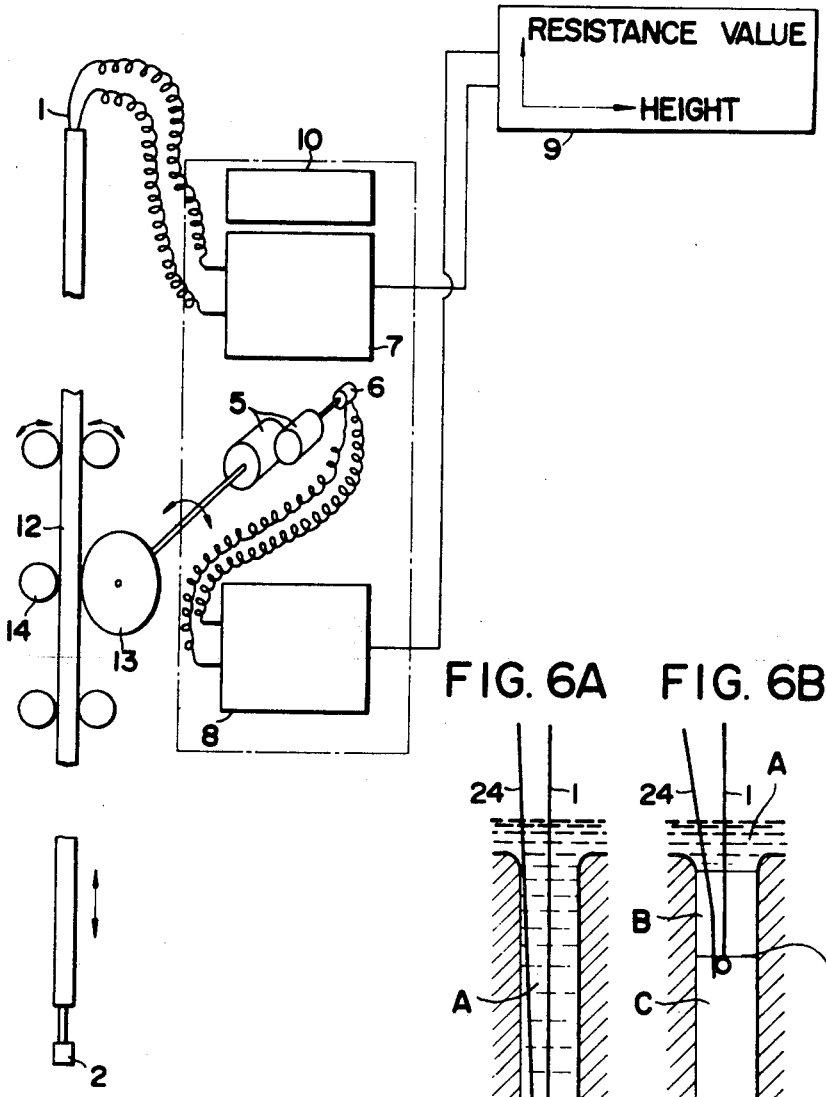
FIG. 4 is a schematic view showing another embodiment of the monitoring device shown in FIG. 3.

The loading of explosives in an underwater blasting operation according to this invention is shown in FIGS. 3 and 4. By using a device for remotely monitoring the state of the loaded explosive, the underwater blasting operation can be safely and efficiently effected. The apparatus for monitoring the state of the loaded fluid explosive according to this invention comprises (a) an install member located above an explosive loading hole and having an electric conductivity measuring electrode at the lowermost end thereof, such installation member including, in a single unit, an electrode adapted to be moved up and down to a required height in the explosive loading hole by means of a lifting arrangement and a variable resistor associated with the lifting arrangement to be rotated thereby, the resistance value of the resistor being variable in relation to the change in height of the electrode, and (b) a remote monitoring member located separately from said installation member so as to be connected therewith through an electric conductivity measuring circuit for converting the electric conductivity of the liquid between the electrodes into an electric signal in terms of an electric resistance value, a depth or height measuring circuit for converting the resistance value of the variable resistor into a voltage signal proportional to the depth (or height), and a control circuit adapted to operate the lifting arrangement as desired.

The apparatus according to this invention enables one to obtain information on electric conductivity and depth in a blasting hole at any depth of sea or lake bed while staying on ship board or at a remote place. The depth of the fluid explosive inside the loading hole and intrusion of any sea water or other foreign matter into the hole can be monitored directly.

The apparatus according to this invention will now be described in detail with reference to the accompanying drawings. In FIG. 3, numeral 1 denotes a flexible windable cord having at one terminal end a weight and an electric conductivity measuring electrode 2. The cord 1 is wound on a drum 3 which has a spiral grooved periphery. As the drum is rotated, the cord is wound or unwound. The drum 3 is rotated by means of a motor 4 driven through a control device. The rotation of the drum and the synchronized rotation of gears 5 is transmitted to a multi-rotation precision variable resistor 6 which changes its resistance upon rotation. The electrode 2 and the variable resistor 6 are supported on an installation member (not shown) placed above the blasting hole. The conductivity measuring electrode 2 is connected electrically to an electric conductivity measuring circuit 7 and the multi-rotation variable resistor 6 is connected electrically to a depth measuring circuit 8; and the information received by these circuits respectively is converted by them into electrical signals and transmitted to an XY recorder 9. The rotation of motor 4 is controlled by an operation panel 11 through a control circuit 10. The XY recorder 9 and the operation panel 11 are installed on a suitable monitoring vehicle such as a ship on the sea.

In the embodiment shown in FIG. 4, instead of hanging a cord into the hole, a rod 12 in which the cord is embedded is arranged for up-and-down movement. The rod 12 in which cord 1 is sealed is raised or lowered by rotation of a driving wheel 13 which is engaged thereby. The reference numeral 14 represents a guide roller. Other parts are the same as shown in FIG. 3 and indicated by the same reference numerals. Incidentally, the circuits 7, 8, and 10, and motor 4, gears 5 in each of FIGS. 3 and 4 are housed in a watertight box. The system of using a rod as shown in FIG. 4 can be used not only for the vertical blasting holes but also for slanted blasting holes.

Figure 5:
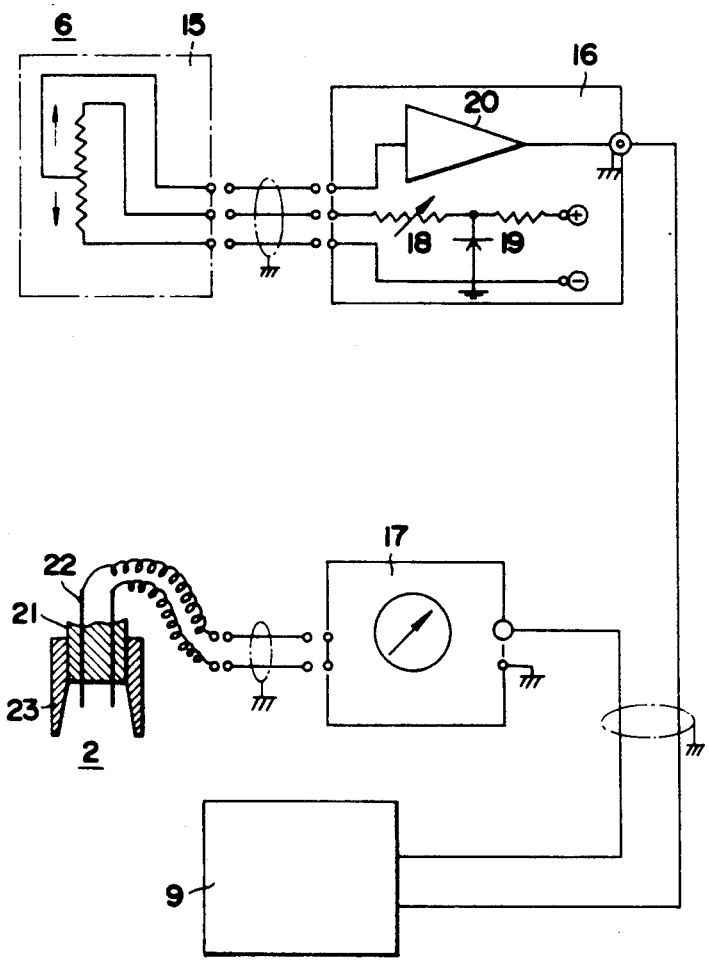
FIG. 5 is a view of the electrical circuit for converting the electric conductivity of a fluid into an electric signal.

FIG. 5 is a diagram showing the system for converting the depth and electric conductivity into electrical signals. In the upper half of FIG. 5 is shown the part that converts the depth into an electrical voltage proportional thereto and in the lower half the part that indicates the electric conductivity in terms of an electrical resistance value. In the FIGURE, numeral 15 stands for a 10-revolution variable resistor corresponding to the resistor 6 in the aforementiond FIGS. 3 and 4, numeral 16 for a depth measuring circuit, numeral 2 for an electrode, numeral 17 for a direct current resistance measuring circuit, and numeral 9 for an XY recorder. The electrode 2 is raised or lowered by the cord wound on the drum as aforementioned. If it is assumed that the effective diameter of the drum is R cm, the up-and-down movement of the electrode per one revolution of the drum will be $\pi R$ cm. If the ratio between the revolution of the drum and the revolution of the 10-revolution variable precision resistor is $n$, the electrode attached at the terminal end of the cord will rise or fall 10 $n\pi R$ cm per 10 revolutions of the variable resistor. If the gears are so selected that 10 $n\pi R$ cm will meet the depth of the blasting hole, the depth could be measured most precisely. Since a predetermined DC voltage is applied to the variable resistor 18 by means of a zener diode 19, a voltage signal proportionate to the depth can be obtained from the variable terminal of the variable resistor 18. The voltage signal thus obtained is amplified, if necessary, by an amplifier 20 and transmitted to the XY recorder 9 installed either on ship or on shore by wires connected to the X-axis terminal of the XY recorder.

The electrode 2 in FIG. 5 comprises two lengths of fine metallic rods 22 embedded in an electrical insulator rod 21 (made of TEFLON) and extending a few mm beyond the surface of insulator 21. For protection of the metallic rods, the lower part of insulator 21 is, as shown, surrounded by a protective cylinder 23. The electrode is connected to a meter 17, which is a DC resistance measuring meter, by a waterproof cord, and the resistance value from the meter is either read directly or the signal from the output terminal of the meter is fed into the Y-axis terminal of the XY recorder 9 for recording on recording paper. In the DC resistance meter system, no accurate value of electric conductivity can be obtained. For the reason of depolarization, the response of the resistance value to the stationary value is slow, but the DC resistance meter is sufficient for the use of the monitoring device and is reasonable in cost. Furthermore, for the reason of long electrical cord being required for this system, an AC system is not proper.

In FIGS. 3 and 4, the control circuit 10 is chiefly composed of relays and receives control signals transmitted by the operation panel 11 so as to effect starting, stopping, and changing the direction of rotation of the driving motor 4 for raising and lowering the electrode and engaging or disengaging a clutch placed between the rotary shaft of the multi-rotation precision variable resistor 6 and the rotary shaft of the drum.

As mentioned, this device can effectively be used for detecting the presence of the fluid explosive and its depth electrically, and remotely monitoring the explosive loading state, for example, whether the loaded fluid explosive has been mixed with sea water or washed away with the lapse of many days after completion of the loading of explosives. Further, this device can be used for monitoring the loading process of the explosive.

Figure 6A:
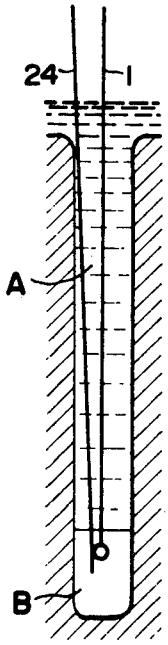
FIGS. 6A and 6B are schematic views showing the method of using the device of FIG. 3 at the time of loading the fluid explosive into a blasting hole.
Figure 6B:
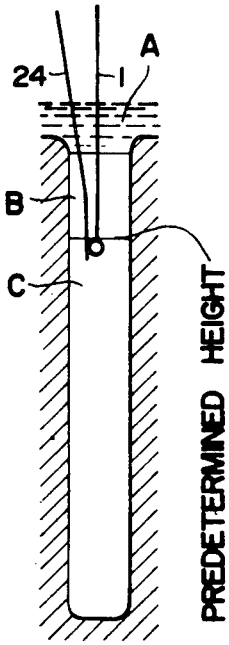

FIGS. 6A and 6B are illustrative diagrams of the principle of monitoring. In this case, the lower terminal end of a flexible pipe 24 for feeding the explosive is fixed at a position slightly below the electric conductivity measuring electrode of the monitoring device and the pipe 24 and the cord 1 are raised or lowered together. First, the fluid B having an intermediate specific gravity is injected into the explosive loading hole. If an electrically insulating liquid is used as the fluid B, the depth of the boundary surface between the fluid B and sea water A can be found by this monitoring device. As shown in FIG. 6A, the cord 1 is allowed to fall to a proper depth from the boundary surface and then the explosive C is injected into the loading hole through the same pipe. By injection of explosive C, the fluid B is pushed upwards, thus raising the boundary surface between the fluids B and C. Since the two fluids are considerably different in electric conductivity, the interface of the two fluids can be traced easily by gradually pulling the cord. When the interface level of the fluids rises to a predetermined depth, the injection of the explosive C will be stopped. By this method, even a fluid explosive which is soluble in sea water can be loaded in an underwater blasting hole at a desired depth without getting mixed with sea water. The explosive loading condition tracing process described above can easily be automated by feedback of the information of electric conductivity to the control circuit.

The device of this invention is, as mentioned before, simple in construction and has many technical merits.

Figure 7A:
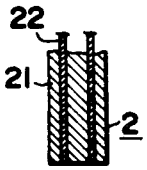
FIGS. 7A and 7B are detail sectional views of one embodiment of the electrodes used for measuring the electric conductivity of the fluid.
Figure 7B:
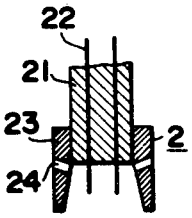

FIGS. 7A and 7B each shown an embodiment of the electric conductivity measuring electrode 2. FIG. 7A shows diagrammatically a plastic rod 12 of 10 mm in diameter in which copper electrode wires 22 of 1.2 mm in diameter are embedded 7 mm apart as electrodes and their lower terminal ends are polished. FIG. 7B shows a plastic rod 21 wherein copper wires 22 of 0.2 mm in diameter are embedded as electrodes at a distance of 3 mm in the plastic rod 21 and their lower terminal end extends downwardly about 5 mm and wherein a protective cylindrical collar is attached at the lower end of the plastic rod for protection of the copper wires and water passage holes 24 are provided in several places.

When a $CCl_4$/silicone oil mixture is used as the fluid B in the system of FIG. 6, an aqueous hydrazine hydrate solution (20° C) saturated with hydrazine nitrate or a saturated aqueous solution (20° C) of hydrazine nitrate is used as the fluid C, and a 4% aqueous solution of sodium chloride is used in place of sea water, and the electrical resistance between the respective electrodes upon immersion in the fluids are measured by a resistance meter, the following results are obtained.

| | 7A | 7B |
|---|---|---|
| Aqueous hydrazine hydrate solution saturated with hydrazine nitrate | 24KΩ | 33KΩ |
| Saturated aqueous solution of hydrazine nitrate | 46KΩ | 65KΩ |
| 4% Aqueous solution of sodium chloride | 160KΩ | 250KΩ |
| $CCl_4$/silicon oil mixture | >50MΩ | >50MΩ |

As shown in the above table, the individual fluids can be differentiated by either type of electrode and either is satisfactorily usable, but in the case of electrode 7A, its end face was wetted with the fluid B. When this electrode was dipped into other fluid from the fluid B, the fluid B sticks to the electrode and a considerable time was needed to remove the fluid B. Such problems could be solved by using a smaller size wire and letting it project out into the fluid as shown in FIG. 7B which showed the desirability of making the electrode like that of FIG. 7B.

The present invention will now be explained in more detail by way of examples, but it is apparent that the scope of the invention is not limited to these examples.

EXAMPLE 1 —PREPARATION OF FLUID EXPLOSIVE

A. Synthesis of Urea Perchlorate

606 Grams of urea were added to 1040 g of 35% hydrochloric acid and dissolved therein under agitation. Then, 1405 g of sodium perchlorate were added to the solution and the mixture was stirred vigorously for 10 minutes at 40° C and cooled to 20° C. The precipitated crystals were separated by filtration. These crystals were sodium chloride. The filtrate contained about 65% of urea perchlorate but still contained a small amount of sodium chloride dissolved therein. Thus, the filtrate was concentrated under reduced pressure at a temperature below 80° C and filtered while hot, thereby removing the majority of the sodium chloride. By repeating this procedure comprising concentration and cooling for the aqueous solution of urea perchlorate thus obtained, crystals of urea perchlorate could be produced in a high yield.

The urea perchlorate prepared in this manner is a colorless crystal in the form of thin plates with a melting point of 82° C and a solubility in 100 parts of water of 950 parts at 20° C. It is a strongly explosive substance, but it is chemically very stable without any danger in handling. Furthermore, a saturated aqueous solution of this compound readily dissolves various organic substances.

B. Fluid Explosive Composition

1. Fluid explosive compositions having various different ingredients as shown in the following table were prepared and their specific gravity, impact sensibility and detonation velocity were measured. The results are shown in the following table. The impact sensibility was determined, according to JIS using a 5 kg drop hammer testing machine, by dropping a hammer six times from a height of 60 cm.

In determining the detonation of velocity, each explosive composition was put in a brass tube of 10 mm in internal diameter and detonated with a No. 6 detonator and the detonation velocity was measured according to the ion gap method.

In the table, the test results obtained for nitroglycerin and nitromethane are also shown for comparison. The data tabulated obviously shows that all of the fluid explosive composition of this invention are considerably less sensitive and much safer in handling than nitroglycerin and their explosive characteristics are superior to those of nitroglycerol.

TABLE

| Composition Ratio by Wt. | | Spec. Grav. (20° C) | Deton. Veloc. | Impact Sensibility Firing Ratio | Impact Sensibility Drop Ht. (cm) |
|---|---|---|---|---|---|
| Nitromethane | 80 | | | | |
| Urean perchlorate | 20 | 1.24 | 6560 | 0/6 | 60 |
| Nitromethane | 30 | | | | |
| Urea perchlorate | 70 | 1.46 | 7070 | 0/6 | 60 |
| Nitromethane | 20 | | | | |
| Urea perchlorate | 78 | 1.51 | 7220 | 0/6 | 60 |
| Water | 2 | | | | |
| Nitromethane | 20 | | | | |
| Urea perchlorate | 70 | 1.44 | 7040 | 0/6 | 60 |
| Water | 10 | | | | |
| Nitromethane | 16 | | | | |
| Nitroethane | 24 | 1.38 | 6720 | 0/6 | 60 |
| Water | 60 | | | | |
| Nitromethane | 26 | | | | |
| Nitropropane | 13 | 1.38 | 6730 | 0/6 | 60 |
| Urea perchlorate | 61 | | | | |
| Nitromethane | 40 | | | | |
| *TNEOF | 50 | 1.44 | 7330 | 0/6 | 60 |
| Urea perchlorate | 10 | | | | |
| Nitroethane | 15 | | | | |
| Urea perchlorate | 85 | 1.49 | 7150 | 0/6 | 60 |
| Nitropropane | 15 | | | | |
| Urea perchlorate | 85 | 1.47 | 7080 | 0/6 | 60 |
| Nitroglycerol | | 1.59 | 7500 | 4/6 | 30 |
| Nitromethane | | 1.13 | 6270 | 0/6 | 60 |

*TNEOF stands for trinitroethyl orthoformate.

2. 10 Parts by weight of nitrobenzene, 88 parts by weight of urea perchlorate and 2 parts by weight of water were mixed to form a fluid explosive having a density of 1.44 g/cm³ at 20° C and a detonating velocity of 2,000 m/sec.

3. In 10 parts by weight of acetonitrile were dissolved 90 parts by weight of urea perchlorate to obtain a fluid explosive with a density of 1.38 g/cm³ and a detonating velocity of 1,900 m/sec.

4. To 50 parts by weight of a 85% aqueous solution of urea perchlorate were added 30 parts by weight of potassium perchlorate powder and 30 parts by weight of ferrosilicon powder. The mixture was stirred to obtain a slurry explosive composition with an apparent specific gravity of 1.91. This explosive composition showed a detonating velocity of 3,700 m/sec. When a 5 kg-hammer dropping test was repeated six times from a height of 60 cm according to JIS, no explosion occurred in all cases.

5. To 70 parts by a weight of a 88% aqueous solution of urea perchlorate were added 15 parts by weight of urea nitrate powder and 15 parts by weight of dinitrotoluene powder. The mixture was stirred to obtain a slurry explosive composition having an apparent specific gravity of 1.45. It showed a detonation velocity of 3710 m/sec. and a sensitivity of 0/6 at 60 cm in a hammer dropping test.

6. To 45 parts by weight of a 80% aqueous solution of urea perchlorate were added 5 parts by weight of acetonitrile, 20 parts by weight of ferrosilicon powder, 5 parts by weight of urea powder and 25 parts by weight of potassium nitrate powder. The mixture was stirred to obtain a slurry explosive composition with an apparent specific gravity of 1.68. It showed a detonation velocity of 2410 m/sec. and a sensitivity of 0/6 at 60 cm in a hammer dropping test.

7. In 72 parts by weight of a 855 aqueous solution of urea perchlorate were dissolved 8 parts by weight of picric acid. To the solution was then added one part by weight of polyacrylamide and the mixture was allowed to stand. To the resulting highly viscous liquid substance were added 9 parts by weight of powdery potassium nitrate and 10 parts by weight of ferrosilicon powder and the mixture was stirred to obtain a slurry explosive composition having an apparent specific gravity of 1.69. It showed a detonation velocity of 6100 m/sec.

EXAMPLE 2 — UNDERWATER BLASTING

1. In the center of the top surface of a cylindrical reinforced concrete block (about 260 kg/cm$^2$ in compression strength) having a diameter of 40 cm and a height of 60 cm, a blasting hole of 30 cm in depth and 2 cm in diameter was made. This concrete block was sunk in water about 1.5 mm (clearance between the water surface and the top surface of the concrete block) below the water surface with the blasting hole opening upwardly and fixed in that position.

Next, a tube of 0.5 cm ID and about 3 m in length made of vinyl chloride resin was inserted into the lowermost part of the blasting hole. Through the tube 30 ml of a viscous fluid consisting of a mixture of carbon tetrachloride and silicone oil (mixing ratio by weight — 40/60, density — 1.24 g/cm, viscosity — 2.5 cp) was poured into the blasting hole through the tube. After a few minutes, another similar tube made of vinyl chloride resin was inserted into the lowest part of the blasting hole. About 10 ml of a fluid explosive composition composed of hydrazine, water and hydrazine nitrate (mixing ratio by weight — 13/9/78, density — 1.41 g/cm$^3$) was poured into the blasting hole through the tube.

After completion of the above procedure, a No. 6 electric detonator supported with a rod was inserted into the lowest part of the blasting hole and a firing cable was connected to the detonator. The explosive was detonated electrically whereby a violent explosion occurred and the concrete was destroyed to the extent that its original, shape was not recognizable, retaining the exposed steel used for reinforcement of the concrete.

2. Except that the fluid explosive was electrically detonated 5 hours after the loading of the explosive in the blasting hole, the operation as in Example 2 (1) was repeated. In this case, the fluid explosive did not mix with water and a satisfactory explosion was obtained and the concrete block was destroyed without leaving any trace of its original form.

3. As in Example 2 (1), 30 ml of a mixture of carbon tetrachloride and silicone oil were injected into a blasting hole bored in the cylindrical shaped reinforced concrete block placed 2 meters below the water surface. Then, 15 g of a slurry explosive (apparent specific gravity about 1.4) composed of ammonium nitrate/hexogen/water/viscosity increasing agent (mixing ratio by weight — 50/35/14/1) was injected into the blasting hole through a tube of vinyl chloride resin having an inside diameter of 10 mm. After about 3 hours, a No. 6 electric detonator having on its surface 5 g of tightly bonded tetryl pellets as a booster was inserted into the lowest part of the blasting hole and electrically detonated. The concrete block was destroyed without leaving any trace of its original form.

Obviously, many modifications and variations of the present invention are possible in the light of the above teachings. It is, therefore, to be understood that within the scope of the appended claims in the invention may be practiced otherwise than as specifically described.

What is claimed is:

1. A fluid explosive composition which comprises urea perchlorate as the essential explosive agent and a normally liquid combustible polar organic compound.

2. The composition of claim 1 in which said urea perchlorate constitutes at least about 60% by weight thereof.

3. A composition according to claim 1 wherein said combustible polar liquid is a liquid nitro compound, a liquid alcohol, a liquid nitrile, a liquid ester, a liquid ketone or a liquid amide.

4. A slurried explosive composition which comprises urea perchlorate as the essential explosive agent, a solid combustible agent and water.

5. The composition of claim 4 wherein said urea perchlorate is dissolved in said water in a concentration of at least about 50%.

6. A composition according to claim 4 which comprises an aqueous solution of urea perchlorate containing a solid combustible agent in the form of a solution or slurry.

7. A composition according to claim 4 wherein said solid combustible agent is an inorganic combustible agent, an organic combustible agent, or a metallic combustible agent.

8. A composition according to claim 4 wherein the combustible agent is an aromatic nitro compound.

9. A composition according to claim 4 wherein the aromatic nitro compound is dinitrobenzene, dinitrotoluene, trinitrotoluene, tetryl, and picric acid.

10. A composition according to claim 4 wherein said combustible agent is a carbonaceous powder, aluminum powder, or ferrosilicon powder.

11. An explosive compound consisting essentially of urea perchlorate.

* * * * *